US010449552B2

(12) United States Patent
Welch

(10) Patent No.: US 10,449,552 B2
(45) Date of Patent: Oct. 22, 2019

(54) HOME APPLIANCE HAVING A FILTER

(71) Applicant: WHIRLPOOL CORPORATION, Benton Harbor, MI (US)

(72) Inventor: Rodney Michael Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/835,594

(22) Filed: Dec. 8, 2017

(65) Prior Publication Data

US 2019/0176165 A1 Jun. 13, 2019

(51) Int. Cl.

| | |
|---|---|
| ***B03C 1/28*** | (2006.01) |
| ***D06F 13/00*** | (2006.01) |
| ***D06F 37/38*** | (2006.01) |
| ***D06F 23/04*** | (2006.01) |
| ***D06F 37/24*** | (2006.01) |
| ***D06F 39/08*** | (2006.01) |
| ***D06F 39/04*** | (2006.01) |
| ***D06F 33/02*** | (2006.01) |
| ***D06F 39/00*** | (2006.01) |
| ***D06F 39/10*** | (2006.01) |
| ***A47L 15/42*** | (2006.01) |
| ***D06F 39/02*** | (2006.01) |

(52) U.S. Cl.

CPC ..... *B03C 1/288* (2013.01); *A47L 15/4208* (2013.01); *D06F 13/00* (2013.01); *D06F 23/04* (2013.01); *D06F 33/02* (2013.01); *D06F 37/24* (2013.01); *D06F 37/38* (2013.01); *D06F 39/005* (2013.01); *D06F 39/02* (2013.01); *D06F 39/04* (2013.01); *D06F 39/085* (2013.01); *D06F 39/088* (2013.01); *D06F 39/10* (2013.01); *B03C 2201/18* (2013.01)

(58) Field of Classification Search

CPC ..... B03C 1/288

See application file for complete search history.

(56) References Cited

U.S. PATENT DOCUMENTS

| | | | |
|---|---|---|---|
| 5,932,096 | A | 8/1999 | Saho et al. |
| 8,002,976 | B2 | 8/2011 | Saho et al. |
| 9,554,688 | B2 | 1/2017 | Geda et al. |

FOREIGN PATENT DOCUMENTS

| | | | |
|---|---|---|---|
| CN | 203954841 | U | 11/2014 |
| JP | 2000005523 | A | 1/2000 |

*Primary Examiner* — Jason Y Ko

(74) *Attorney, Agent, or Firm* — McGarry Bair PC

(57) ABSTRACT

A household appliance can include a tub at least partially defining a treating chamber for holding liquid with an access opening, a nozzle emitting liquid into the treating chamber, a recirculation circuit fluidly coupling the treating chamber to the nozzle. The recirculation circuit can include a recirculation pump and a filter having a housing with an inlet and an outlet, ferrite particles located within the housing, and a magnet having a first operational state and a second operational state.

17 Claims, 6 Drawing Sheets

HOME APPLIANCE HAVING A FILTER

BACKGROUND

Conventional automatic cleaning appliances, such as home appliances including laundry treating appliances, dishwashers, and the like, involve the mixing of treating chemistry with water to create a wash liquid or rinse liquid to facilitate the cleaning process. Soils can be loosened during the cleaning process, and various methods exist to remove such soils from the wash or rinse liquid during the cleaning process. A recirculation circuit can draw soiled liquid from the cleaning appliance and pump the soiled liquid through a filter. The filter can remove soils from the liquid so that clean liquid can be recirculated for re-use in the cleaning appliance.

BRIEF DESCRIPTION

In one aspect, the present disclosure relates to a household appliance including a tub at least partially defining a treating chamber for holding liquid with an access opening, a nozzle emitting liquid into the treating chamber, a recirculation circuit fluidly coupling the treating chamber to the nozzle, the recirculation circuit comprising a recirculation pump and a filter including a housing defining an interior and having a housing inlet fluidly coupled to the treating chamber and a housing outlet fluidly coupled to the nozzle ferrite particles located within the housing and surrounding the housing inlet and fluidly separating the housing inlet from the housing outlet, and a magnet having a first operational state where the ferrite particles filter liquid passing from the housing inlet to the housing outlet and a second operational state where the ferrite particles do not filter liquid passing from the housing inlet to the housing outlet.

In another aspect, the present disclosure relates to a household appliance including a tub at least partially defining a treating chamber for holding liquid with an access opening, a nozzle emitting liquid into the treating chamber, a recirculation circuit fluidly coupling the treating chamber to the nozzle, the recirculation circuit comprising a recirculation pump and a filter including an inlet fluidly coupled to the treating chamber, an outlet fluidly coupled to the nozzle, a housing defining an interior and having ferrite particles in the interior and fluidly separating the inlet from the outlet, and a magnet having a first operational state where the ferrite particles filter liquid passing from the inlet to the outlet and a second operational state where the ferrite particles do not filter liquid passing from the inlet to the outlet.

In yet another aspect, the present disclosure relates to a method of pumping liquid in a household appliance through a filter comprising the steps of filtering liquid being pumped through ferrite particles located in a housing having an inlet and an outlet fluidly separating the inlet from the outlet when a magnet is in a first operational state, and not filtering liquid being pumped through ferrite particles located in a housing having an inlet and an outlet fluidly separating the inlet from the outlet when a magnet is in a second operational state.

DETAILED DESCRIPTION

Illustrative cleaning appliances in accordance with the present disclosure include a recirculation circuit a having a filter containing a filter media in the form of ferrite particles. The magnetic nature of the ferrite particles allows for the particles to be retained within the filter without the use of a screen. The filter can be rotated or employ a magnet to aid in restraining the ferrite particles. Additionally, the proximity of the attracted particles provides a filter media that is capable of filtering soiled liquid down to less than 2 μm.

Figure 1:
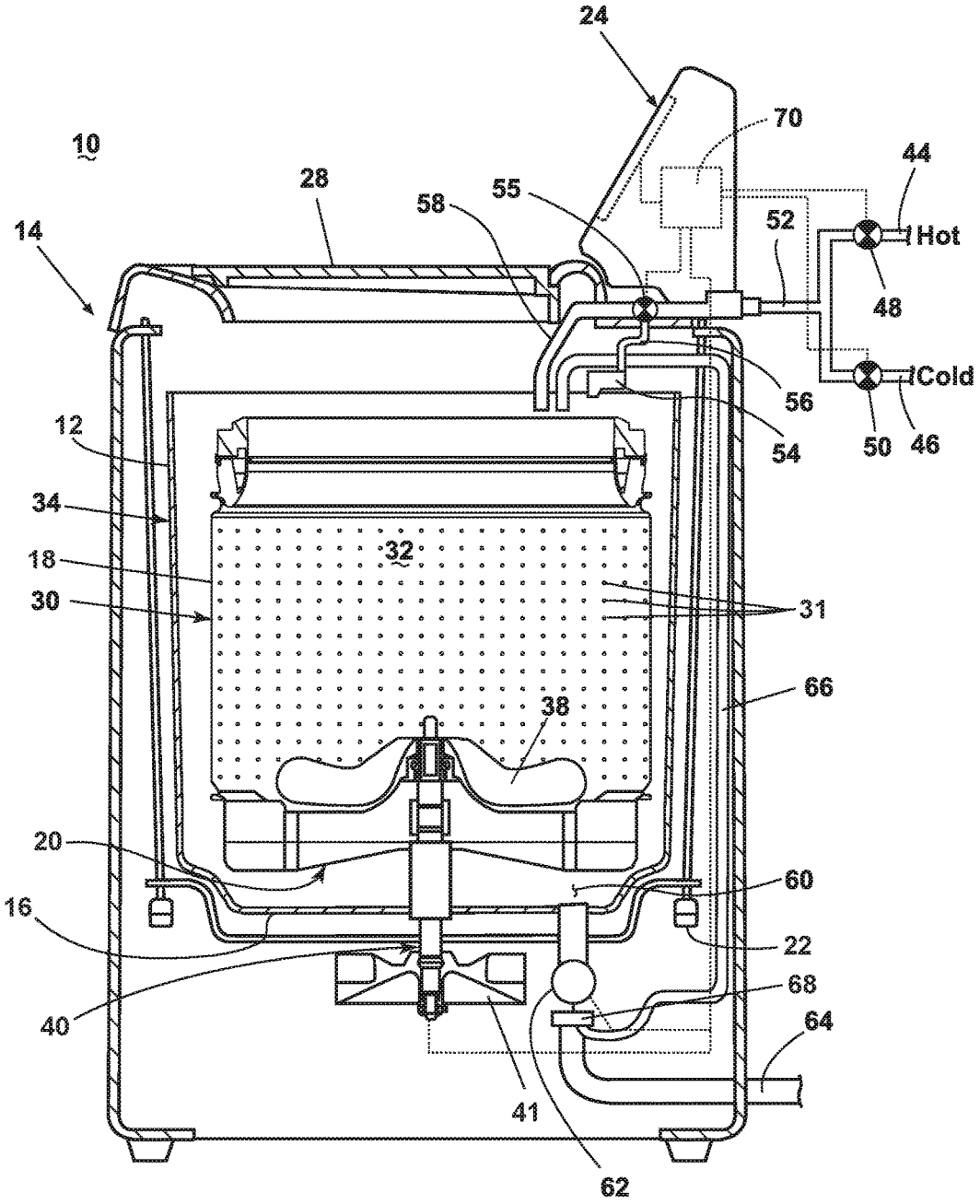
FIG. 1 illustrates a schematic view of an exemplary home appliance in the form of a washing machine according to aspects described herein.

FIG. 1 illustrates a schematic cross-sectional view of a home appliance, such as a laundry treating appliance, shown in the form of a washing machine 10 according to one embodiment of the present disclosure. While the laundry treating appliance is illustrated as a vertical axis, top-fill washing machine, the embodiments of the present disclosure can have applicability in other fabric treating appliances, non-limiting examples of which include a combination washing machine and dryer, a refreshing/revitalizing machine, an extractor, or a non-aqueous washing apparatus.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary washing machine of FIG. 1 is a vertical axis washing machine.

The washing machine 10 can include a structural support system comprising a cabinet 14 that defines a housing, within which a laundry holding system resides. The cabinet 14 can be a housing having a chassis and/or a frame defining an interior that receives components typically found in a conventional washing machine, such as motors, pumps, fluid lines, controls, sensors, transducers, and the like. Such components will not be described further herein except as necessary for a complete understanding of the present disclosure. The top of the cabinet 14 can include a selectively openable lid 28 to provide access into the laundry treating chamber 32 through an open top of the basket 30.

The fabric holding system of the illustrated exemplary washing machine 10 can include a rotatable basket 30 having an open top that can be disposed within the interior of the cabinet 14 and may define a treating chamber 32 for receiving laundry items for treatment. A tub 34 can also be positioned within the cabinet 14 and can define an interior within which the basket 30 can be positioned. The tub 34 can have a generally cylindrical side or tub peripheral wall 12 closed at its bottom end by a base 16 that can at least partially define a sump 60.

The basket 30 can have a generally peripheral side wall 18, which is illustrated as a cylindrical side wall, closed at the basket end by a basket base 20 to at least partially define the treating chamber 32. The basket 30 can be rotatably mounted within the tub 34 for rotation about a vertical basket axis of rotation and can include a plurality of perforations 31, such that liquid may flow between the tub 34 and the rotatable basket 30 through the perforations 31. While the illustrated washing machine 10 includes both the tub 34 and the basket 30, with the basket 30 defining the treating chamber 32, it is within the scope of the present disclosure for the laundry treating appliance to include only one receptacle, with the receptacle defining the laundry treatment chamber for receiving the load to be treated.

A clothes mover 38 may be rotatably mounted within the basket 30 to impart mechanical agitation to a load of laundry placed in the basket 30. The clothes mover 38 can be oscillated or rotated about its axis of rotation during a cycle of operation in order to produce load motion effective to wash the load contained within the treating chamber 32. Other exemplary types of laundry movers include, but are not limited to, an agitator, a wobble plate, and a hybrid impeller/agitator.

The basket 30 and the clothes mover 38 may be driven by a drive system 40 that includes a motor 41, which can include a gear case, operably coupled with the basket 30 and clothes mover 38. The motor 41 can rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch can be included in the drive system 40 and can selectively operably couple the motor 41 with either the basket 30 and/or the clothes mover 38.

A suspension system 22 can dynamically hold the tub 34 within the cabinet 14. The suspension system 22 can dissipate a determined degree of vibratory energy generated by the rotation of the basket 30 and/or the clothes mover 38 during a treating cycle of operation. Together, the tub 34, the basket 30, and any contents of the basket 30, such as liquid and laundry items, define a suspended mass for the suspension system 22.

A liquid supply system can be provided to liquid, such as water or a combination of water and one or more wash aids, such as detergent, into the treating chamber 32. The liquid supply system can include a water supply configured to supply hot or cold water. The water supply can include a hot water inlet 44 and a cold water inlet 46, a valve assembly, which can include a hot water valve 48, a cold water valve 50, and a diverter valve 55, and various conduits 52, 56, 58. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated exteriorly of the cabinet 14, it may be understood that these components can be internal to the housing.

As illustrated, a detergent dispenser 54 can be fluidly coupled with the conduit 52 through a diverter valve 55 and a first water conduit 56. The detergent dispenser 54 can include means for supplying or mixing detergent to or with water from the first water conduit 56 and can supply such treating liquid to the tub 34. It has been contemplated that water from the first water conduit 56 can also be supplied to the tub 34 through the detergent dispenser 54 without the addition of a detergent. A second water conduit, illustrated as a separate water inlet 58, can also be fluidly coupled with the conduit 52 through the diverter valve 55 such that water can be supplied directly to the treating chamber 32 through the open top of the basket 30. Additionally, the liquid supply system can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system can be provided for recirculating liquid from the tub 34 into the treating chamber 32. More specifically, a sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. A filter 68 can be located downstream of the pump 62 to clarify wash water prior to recirculating liquid into the treating chamber 32. As illustrated, the recirculation conduit 66 can be fluidly coupled with the treating chamber 32 such that it supplies liquid into the open top of the basket 30. The liquid recirculation system can include other types of recirculation systems.

It is noted that the illustrated drive system, suspension system, liquid supply system, and recirculation and drain system are shown for exemplary purposes only and are not limited to the systems shown in the drawings and described above. For example, the liquid supply, recirculation, and pump systems can differ from the configuration shown in FIG. 1, such as by inclusion of other valves, conduits, treating chemistry dispensers, sensors (such as liquid level sensors and temperature sensors), and the like, to control the flow of liquid through the washing machine 10 and for the introduction of more than one type of treating chemistry. For example, the liquid supply system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump. Alternatively, the heating system can be in the form of an in-line heater that heats the liquid as it flows through the liquid supply, dispensing and/or recirculation systems.

The washing machine 10 can further include a controller 70 coupled with various working components of the washing machine 10 to control the operation of the working components and to implement one or more treating cycles of operation. The control system can further include a user interface 24 that is operably coupled with the controller 70. The user interface 24 can include one or more knobs, dials, switches, displays, touch screens and the like for communicating with the user, such as to receive input and provide output. The user can enter different types of information including, without limitation, cycle selection and cycle parameters, such as cycle options.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
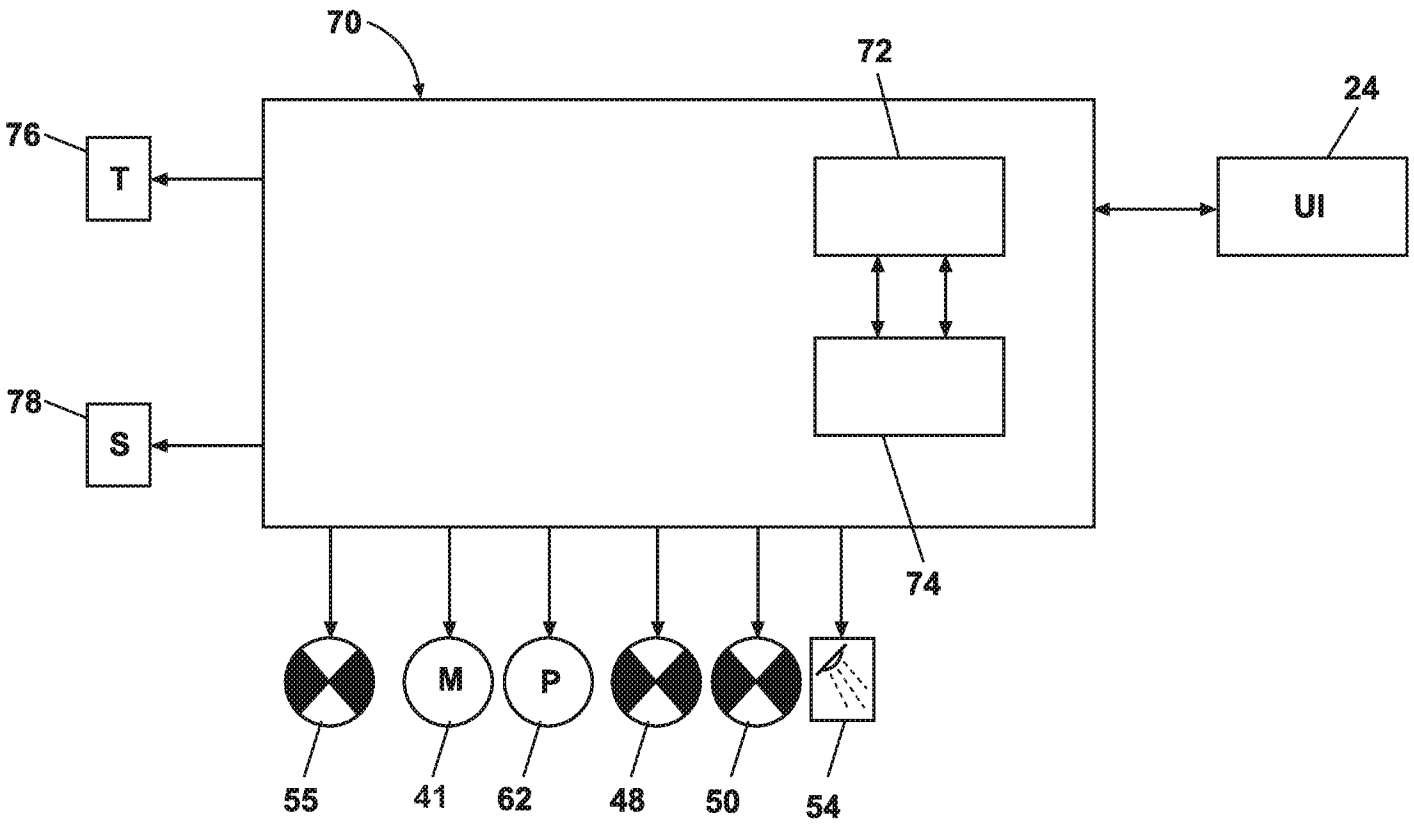
FIG. 2 illustrates a schematic view of a controller of the clothes washer in FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. Examples, without limitation, of treating cycles of operation include: wash, heavy-duty wash, delicate wash, quick wash, pre-wash, refresh, rinse only, and timed wash, which can be selected at the user interface 24. The memory 72 can also be used to store information, such as a database or table, and to store data received from the one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 can be operably coupled with one or more components of the washing machine 10 for communicating with and/or controlling the operation of the components to complete a cycle of operation. For example, the controller 70 can be coupled with the hot water valve 48, the cold water valve 50, diverter valve 55, and the detergent dispenser 54 for controlling the temperature and flow rate of treating liquid into the treating chamber 32; the pump 62 for controlling the amount of treating liquid in the treating chamber 32 or sump 60; drive system 40 including a motor 41 for controlling the direction and speed of rotation of the basket 30 and/or the clothes mover 38; and the user interface 24 for receiving user selected inputs and communicating information to the user. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include: a weight sensor, and a motor torque sensor.

Figure 3:
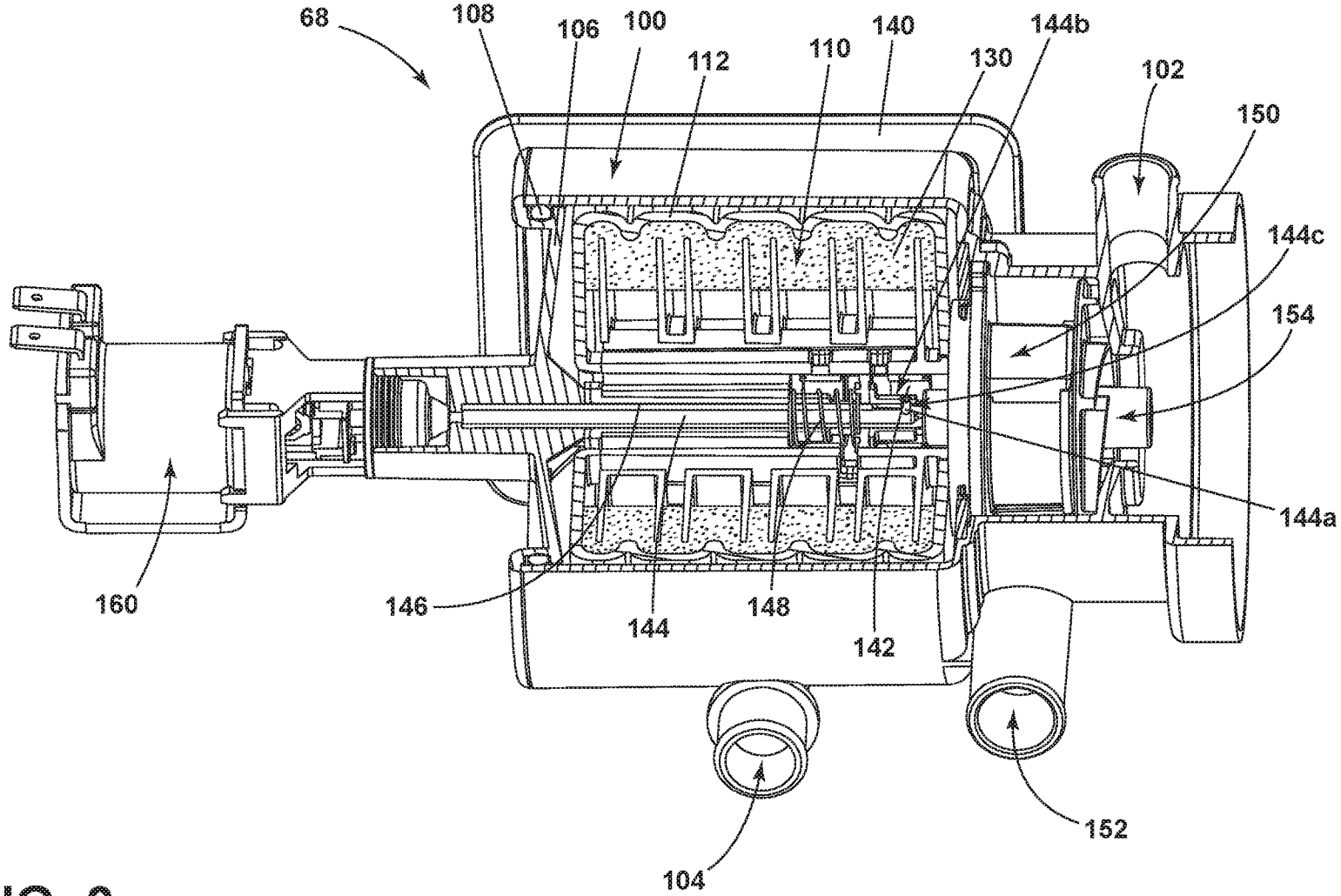
FIG. 3 illustrates a cut-away perspective view of a filter assembly according to aspects described herein.

Turning to FIG. 3, an exemplary embodiment of the filter 68 is illustrated. The filter 68 can include a housing 100 having an inlet 102 and an outlet 104. The housing 100 can include an end cap 106 and a gasket 108 to fluidly seal the housing 100. An interior 110 of the housing 100 can include a rotatable interior housing 112 and ferrite particles 130. The ferrite particles 130 can fluidly separate the inlet 102 and the outlet 104 such that liquid can flow from the inlet 102 to the outlet 104 while passing through the ferrite particles 130. The ferrite particles 130 can aggregate due to the magnetic properties of ferrite such that liquid that flows through the ferrite particles 130 can be clarified down to less than about 0.15 μm. Once the ferrite particles 130 are magnetized during manufacturing, each particle can be a permanent magnet with its own magnetic domain having magnetic poles. This causes the ferrite particles 130 to rotate and shift in order to find a position that lines up North and South poles of adjacent ferrite particles 130, thereby creating an aggregation, or clump of ferrite particles 130.

Furthermore, the housing 100 can include a pre-filter 150 having an outlet 152. The pre-filter 150 can be fluidly coupled to the inlet 102 such that liquid is partially clarified prior to entering the interior 110. The pre-filter 150 can be any suitable filter, with one example being the filter shown and described in U.S. Pat. No. 9,554,688, which is incorporated herein in its entirety. An impeller 154 can be coupled with the pre-filter 150 such that a motor can drive rotation of the pre-filter 150 and the impeller 154. The impeller 154 can push water through the pre-filter 150. Larger soils, such as soils about 150 μm or greater, can be collected by the pre-filter 150 and drained from the outlet 152 such that liquid entering the interior 110 includes soils smaller than 150 μm. The partially clarified liquid can enter an interior inlet (not shown) from the pre-filter 150 and flow into the interior 110.

A solenoid 160 can be provided to actuate an actuating rod 144 in order to move a valve 142 relative to the interior housing 112. A spring 148 can be coupled with the valve actuating rod 144 to return the valve actuating rod 144 to a resting position when the solenoid 160 does not actuate the valve actuating rod 144. A stationary hollow shaft 146 can be coupled to the solenoid 160 such that the actuating rod 144 can slide within in the shaft 146. The actuating rod 144 can further include a pin **144*a* that can be received within a slot 144*c* formed by aligned notches in the hollow shaft 146 and a valve washer 144*b*. Thus, the actuating rod 144 can impart movement to the valve washer 144*b*, which can move the valve 142**.

Figure 4:
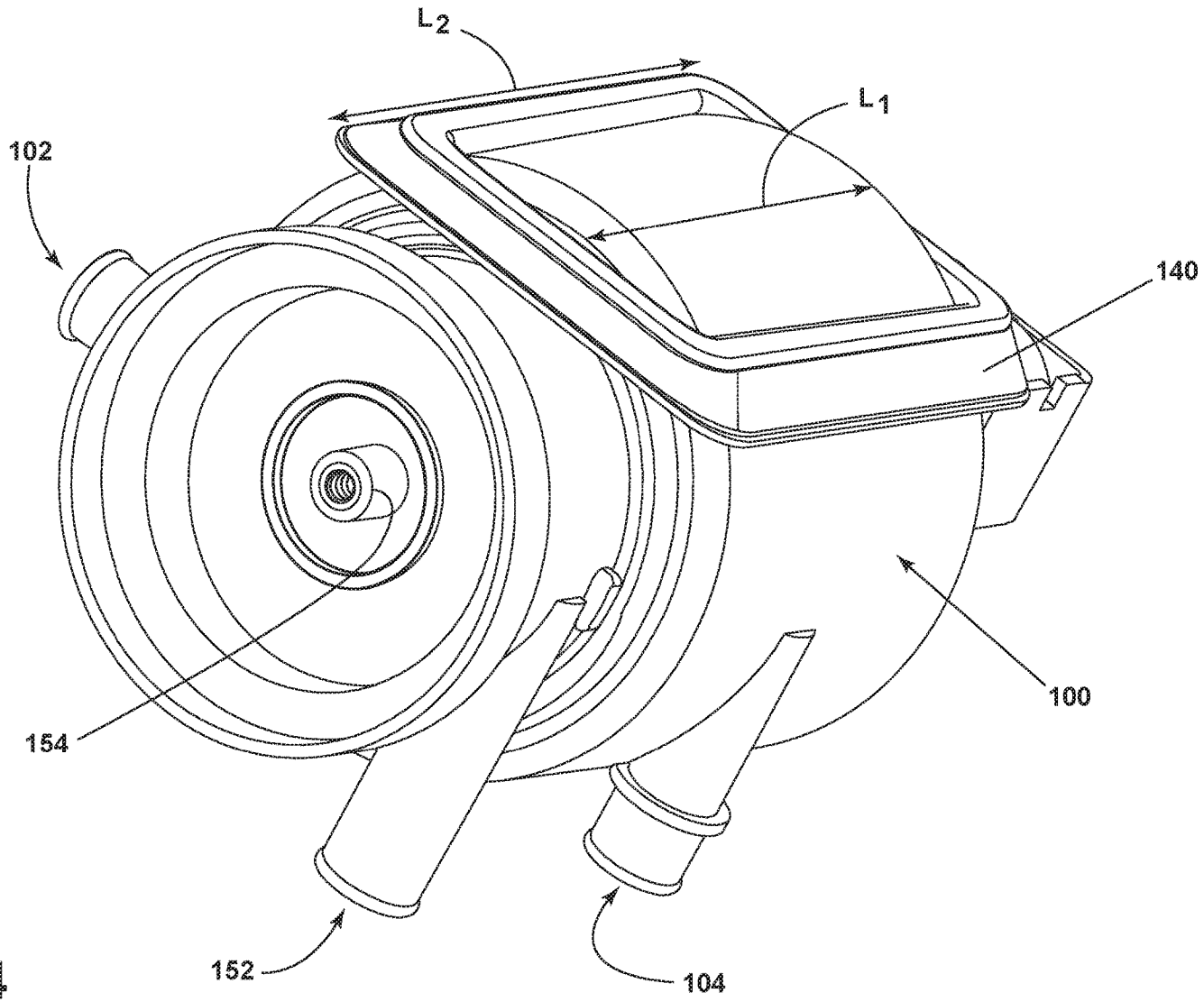
FIG. 4 illustrates a perspective view of a filter according to aspects described herein.

Turning to FIG. 4, a magnet 140 can circumscribe at least a portion of the housing 100 and can preferably be in the form of an electromagnet. The magnet 140 can be rectangular having a longer length, $L_2$, than the length $L_1$ of a cylindrical portion of the housing 100 in order for the magnet 140 to fit over top of at least a portion of the housing 100. The magnet 140 can have a first state, where the magnet 140 can be energized or not energized, and a second state where the magnet 140 is energized or energized differently, or is located adjacent the housing 100. The magnet 140 can impose an external magnetic field in order to disturb or rearrange the ferrite particles 130 such that the ferrite particles 130 align with the external magnetic field of the magnet 140 as opposed to being aligned relative to each other. While it is contemplated that the magnet 140 is an electromagnet, the magnet 140 could also be a permanent magnet without departing from the scope of the present disclosure. If a permanent magnet is used, it is contemplated that the magnet 140 would be moveable relative to the housing 100 to reorient the ferrite particles 130.

Figure 5:
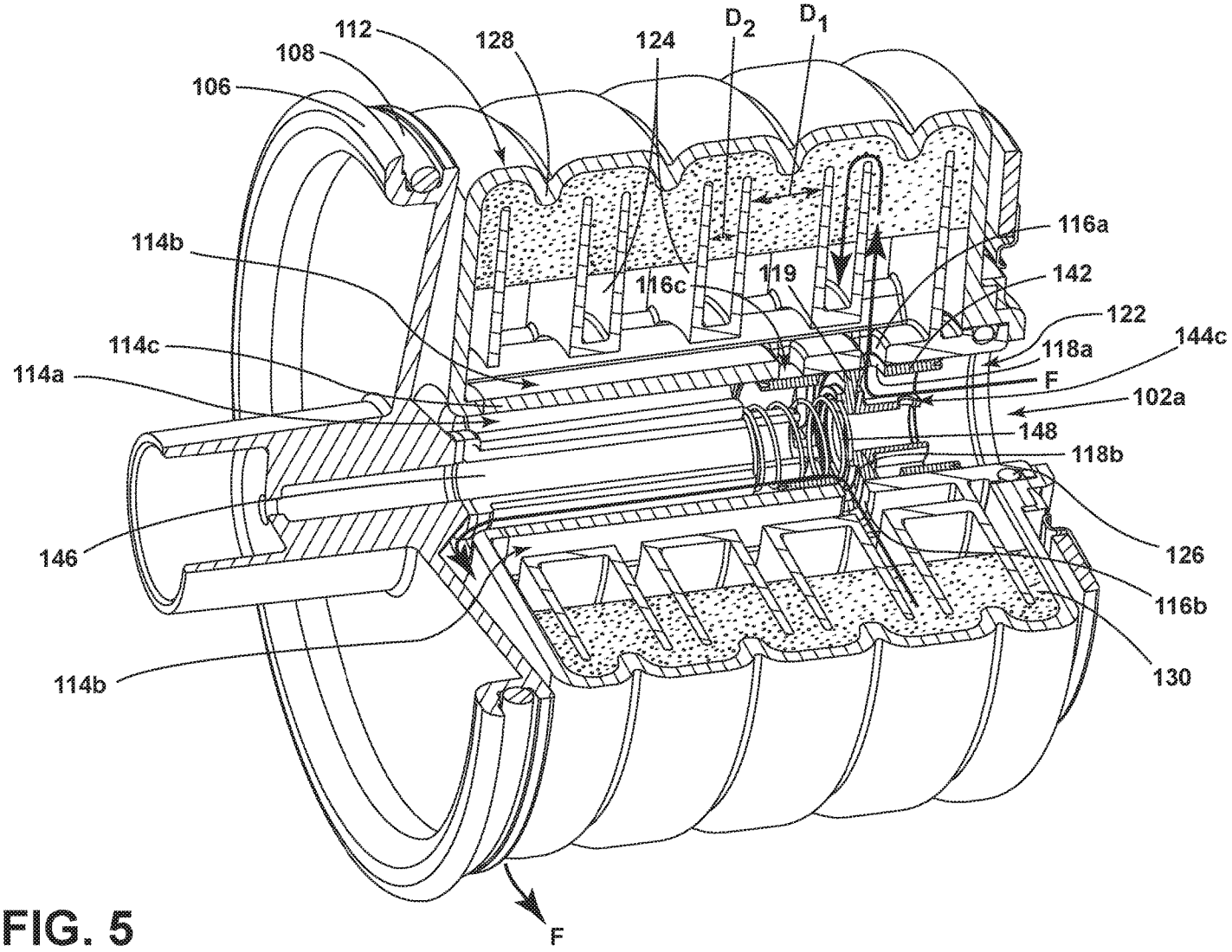
FIG. 5 illustrates cut-out section of a filter housing according to aspects described herein.

FIG. 5 illustrates a cut-out section of the interior 110 to illustrate the valving system associated with the filter 68. In addition to the rotatable interior housing 112, the interior 110 can also include a rotatable axial housing 122 coupled with the interior housing 112 such that the axial housing 122 rotates upon rotation of the interior housing 112. The axial housing 122 can be in the form of a hub and can include the valve 142, the hollow shaft 146, the spring 148, channels 114*a, b* and discs 124. The discs 124 can be arranged in a stacked configuration on the axial housing 122 and can include annular areas that can circumscribe the axial housing 122. The valve 142 can move relative to the axial housing 122. The axial housing 122 within the interior 110 is configured with the plurality of channels 114*a, b* and discs 124 to direct liquid through the filter 68.

The channels 114*a, b* can include a first channel 114*a*, adjacent the hollow shaft 146, and a second channel 114*b* adjacent the first channel 114*a*. A wall 114*c* can separate the first channel 114*a* and the second channel 114*b*. The channel 114*a* can be a fluid outlet from the filter housing and fluidly connect filtered liquid to either a liquid recirculation chamber or to a drain. The second channel 114*b* can act a plenum and distribute liquid through discs 124. A gasket 126 can be provided to fluidly seal the axial housing 122 and the interior housing 112.

The wall 114*c* can include ports 116*a, b, c* where a first port 116*a* is adjacent the interior inlet 102*a*, a second port 116*b* is adjacent the first port 116*a*, and a third port 116*c* is adjacent second port 116*b*. The valve 142 can include a housing comprising spaced annular apertures 118 *a, b* with a liquid stop 119 positioned therebetween. In a first valve position as shown in FIG. 5, the port 116*a* is aligned with an annular aperture 118*a* such that the port 116*a* is in an open positon and the port 116*b* is aligned with annular aperture 118*b*. As will be explained, in this position, referred to the filtering position, liquid entering the interior 110 will exit through port 116*a* travel through the ferrite filter housing and exit the filter housing through port 116*b*. In a second valve position, the valve 142 is pulled back shifting the annular apertures 118*a, b* to the left. In this position, known as a backwash position, the port 116*a* is no longer aligned with annular aperture 118*a*, instead port 116*b* is aligned with annular aperture 118*a* and port 116*c* is aligned with annular aperture 118*b*. In this position, liquid entering the interior 110 will exit through port 116*b* travel through the ferrite filter housing (in the opposite direction) and exit the filter housing through port 116*c*.

The discs 124 can be spaced from each other such that the distance between discs 124 can vary. For example, spacing between the stack of discs 124 can include a first distance, $D_1$, and a second distance, $D_2$ and alternate thereafter in order to create a controlled path for the liquid, or filtrate, through the annular areas of ferrite particles 130. The size of annular areas of ferrite particles 130 vary depending on the location of the ferrite particles within the spaces formed by distance $D_1$ or $D_2$. The alternating $D_1$ spaces forming $D_1$ and containing the annular areas of ferrite particles 130 can be in fluid communication with port 116*a* and channel 114*b* such that in the filtering position, liquid is pushed up through the wider space, $D_1$, and exits through the space $D_2$ into channel 114*a*. The alternating $D_2$ spaces can also be in fluid communication with port 116*b* and channels 114*a, b* such that in the backwash position, the exit to channel 114*a* is blocked, so liquid is pushed up through alternating $D_2$ spaces and exits through port 116*c* associated with the wider $D_1$ spaces.

Furthermore, the interior housing 112 can include dips 128 wherein the interior housing 112 is formed to extend towards the axial housing 122 in between the discs 124. The dips 128 can eliminate dead filtration zones between discs 124 as well as provide structural support for the interior housing 112. In the illustration, the dips 128 can extend towards the axial housing 122 within distance $D_1$. Furthermore, the distal end of discs 124 are spaced from the interior housing 112 such that liquid can effectively flow through the ferrite particles 130. Additionally, the clearance can provide for effective rotation of the axial housing 122 in the event that the axial housing 122 and the interior housing 112 rotate independently of another.

FIG. 5 shows liquid flow, F, through the filter operations. During filter operation, the magnet 140 can be energized or energized to a first state to align the ferrite particles 130 for filtering. In addition, the housing 112 rotates at a first speed to help evenly distribute and hold the ferrite particles against the outer wall of the spinning housing 112.

Once up to speed, the soiled liquid can enter the interior housing 112 via the interior inlet 102*a* in the axial housing 122. The pump 62 or impeller 154 (FIG. 4) can pressurize the pre-filter 150 such that the liquid can then flow through the housing 112. In the filter position, the liquid stop 119 is positioned after the first port 116*a*, thus causing any liquid entering through the inlet 102 to be pushed up the annular aperture 118*a* towards channel 114*b*. Channel 114*b* directs liquid flow into the $D_1$ spaces in the interior 110 and through the filtering ferrite particles 130. Soils from the liquid can accumulate within the ferrite particles 130 such that the liquid is clarified as it flows through the interior 110. The flowing liquid can exit the interior 110 through spaces $D_2$ leading to port 116*b*. After flowing through port 116*b*, the filtered liquid can exit the housing via channel 114*a* where it can drain from outlet 104 (FIG. 3) and be recirculated or drained from the housing. In order to evenly distribute the ferrite particles 130 for efficient filtration, the interior housing 112 and the axial housing 122 can be rotated, for example, by the impeller 154 or by a separate motor.

Figure 6:
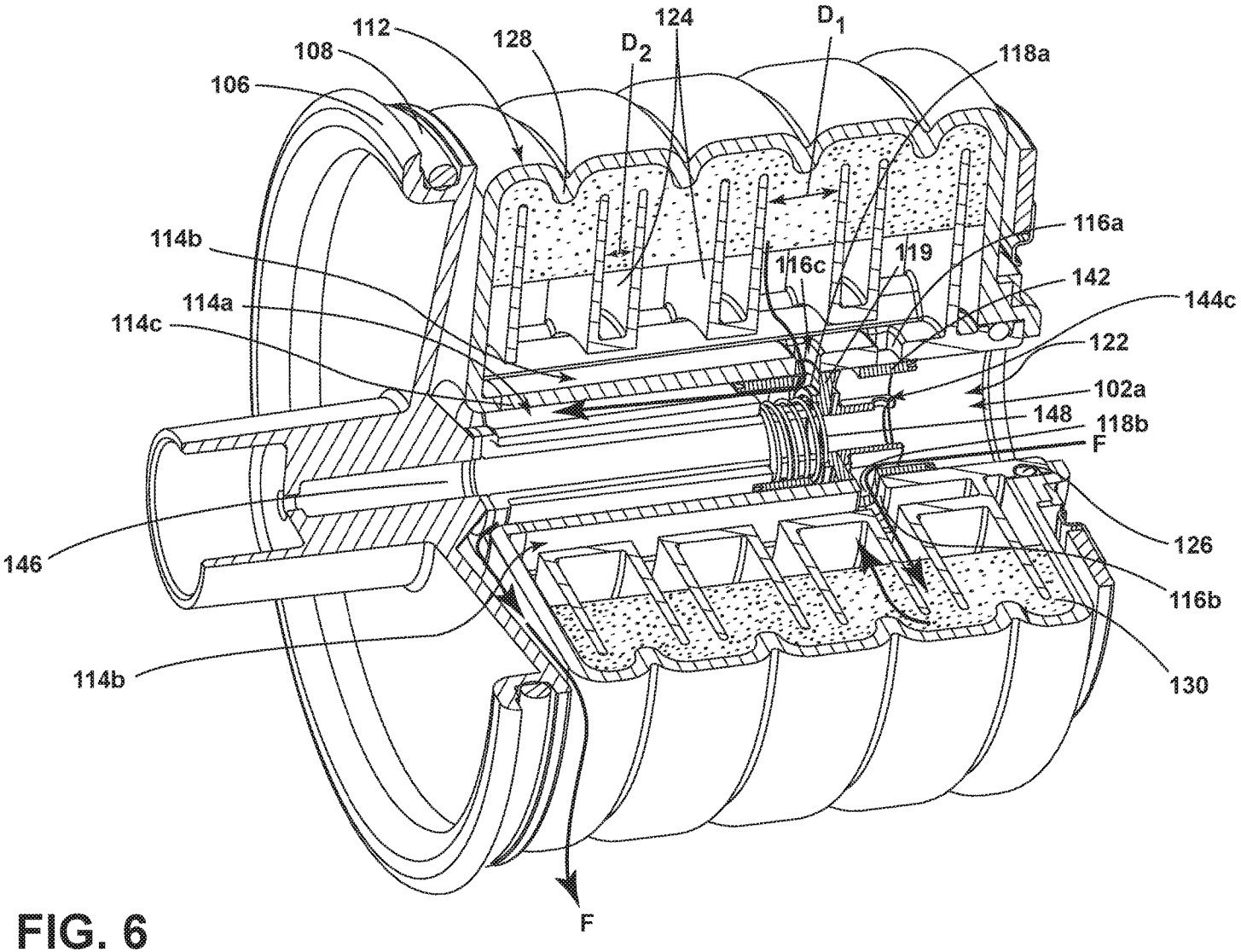
FIG. 6 illustrates a cut-out section of a filter housing according to aspects described herein.

Turning to FIG. 6, liquid flow, F, is shown through backwash operations, where the filter 68 can be cleaned of collected soils lodged in the ferrite particles 130. The collected soils can be dislodged and drained from the housing. A backwash operation can be initiated at an end of a cycle of operation, or alternatively if a relatively high pressure is sensed. In a backwash operation, the magnet 140 can be de-energized or energized to a second state to re-align the ferrite particles 130. During the loosening or re-aligning of the ferrite particles, the position of the ferrite particles 130 are disturbed, thus loosening any trapped or embedded soil. Thus, soils can thus be dislodged from the ferrite particles 130 as liquid flows through and the soils. In addition, it is contemplated that the interior housing 112 and the axial housing 122 can also be rotated during backwash to help loosen and facilitate particle removal. The speed at which the interior housing 112 and the axial housing 122 are rotated during backwashing is contemplated to be a speed slower than the speed of rotation during filtration.

In operation, liquid can flow into the interior housing 112 in a similar manner as described for a filtration operation. Liquid can enter the interior housing 112 via the interior inlet 102*a* in the axial housing 122, however, during backwashing, the valve 142 can be in the second valve or the backwash position. In the backwash position, the valve 142 is activated by the solenoid and pulled toward the solenoid and compressing the spring 148. The valve 142 thus shifts such that the annular aperture 118*a* and the first port 116*a* no longer align. Now, the annular aperture 118*a* aligns with port 116*b*, annular aperture 118*b* aligns with port 116*c*, liquid stop 119 is positioned after the second port 116*b*, and channel 114*a* is blocked at port 116*b* preventing liquid from exiting the port 116*b*. As soiled liquid enters the interior housing 112 via the interior inlet 102, the only outlet for the soiled liquid is through port 116*b* since port 116*a* in now blocked by the valve 142. Thus, any liquid entering through the inlet 102 is pushed up the annular aperture 118 towards channel 114*b*. Channel 114*b* directs liquid flow into the $D_2$ spaces in the interior 110 and through the loosened ferrite particles 130. The flowing liquid, F, pushes the loosened soil particles through the interior spaces $D_1$ leading to port 116*c*. After flowing through port 116*c*, the filtered liquid can exit the housing via channel 114*a* where it can drain from outlet 104 (FIG. 3) and be drained from the housing.

A method of pumping liquid in a household appliance through a filter can include filtering liquid being pumped through ferrite particles located in a housing having an inlet and an outlet fluidly separating the inlet from the outlet when a magnet is in a first operational state, and not filtering liquid being pumped through ferrite particles located in a housing having an inlet and an outlet fluidly separating the inlet from the outlet when a magnet is in a second operational state.

Furthermore, the method can include rotating the housing at a first speed to evenly distribute the ferrite particles about the interior of the housing. The method can also include rotating the housing at a first speed while operating in the first operational state and operating at a second speed, slower than the first speed, while operating in a second operational state.

Benefits of aspects described herein can include a filter that is capable of filtering soiled liquid down to less than 2 μm. The filter can be used for a wide range of applications, including but not limited to, household appliances such as a washing machine or a dishwasher. The filter can be employed during an automatic cycle of operation such that the appliance can be provided with clarified water without the need for a new supply of water.

To the extent not already described, the different features and structures of the various embodiments can be used in combination with each other as desired. That one feature may not be illustrated in all of the embodiments is not meant to be construed that it may not be, but is done for brevity of description. Thus, the various features of the different embodiments can be mixed and matched as desired to form new embodiments, whether or not the new embodiments are expressly described. All combinations or permutations of features described herein are covered by this disclosure. It should be appreciated that the aforementioned method can be used within alternative appliances.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A household appliance comprising:

a tub at least partially defining a treating chamber for holding liquid with an access opening;

a nozzle emitting liquid into the treating chamber;

a recirculation circuit fluidly coupling the treating chamber to the nozzle;

the recirculation circuit comprising a recirculation pump and a filter comprising:

a housing defining an interior and having a housing inlet fluidly coupled to the treating chamber and a housing outlet fluidly coupled to the nozzle;

ferrite particles located within the housing and surrounding the housing inlet and fluidly separating the housing inlet from the housing outlet; and a magnet having a first operational state where the ferrite particles filter liquid passing from the housing inlet to the housing outlet and a second operational state where the ferrite particles do not filter liquid passing from the housing inlet to the housing outlet.

2. The household appliance of claim 1 wherein the housing is rotatable.

3. The household appliance of claim 1 wherein the magnet circumscribes at least a portion of the housing.

4. The household appliance of claim 3 wherein the magnet is one of a permanent magnet or electromagnet.

5. The household appliance of claim 4 wherein the electromagnet has a first state where ferrite particles act as a filter and a second state where the ferrite particles do not act as a filter.

6. The household appliance of claim 5 wherein the housing is rotated at a first speed when the electromagnet is in the first state.

7. The household appliance of claim 6 wherein the housing is rotated at a second speed, slower than the first speed, when the electromagnet is in the second state.

8. The household appliance of claim 4 wherein the permanent magnet is moveable between a first position away from the housing where the ferrite particles act as a filter and a second position adjacent the housing where the ferrite particles do not act as a filter.

9. The filter of claim 1 further comprising a pump for pushing unfiltered liquid through the ferrite particles in the housing.

10. A household appliance comprising:

a tub at least partially defining a treating chamber for holding liquid with an access opening;

a nozzle emitting liquid into the treating chamber;

a recirculation circuit fluidly coupling the treating chamber to the nozzle;

the recirculation circuit comprising a recirculation pump and a filter comprising:

an inlet fluidly coupled to the treating chamber;

an outlet fluidly coupled to the nozzle;

a housing defining an interior and having ferrite particles in the interior and fluidly separating the inlet from the outlet; and a magnet having a first operational state where the ferrite particles filter liquid passing from the inlet to the outlet and a second operational state where the ferrite particles do not filter liquid passing from the inlet to the outlet.

11. The household appliance of claim 10 further comprising a valve moveable between a first position for filtering the liquid passing from the inlet to the outlet and a second position for not filtering the liquid passing from the inlet to the outlet.

12. The household appliance of claim 10 wherein the housing is rotatable.

13. The household appliance of claim 10 wherein the magnet circumscribes at least a portion of the housing.

14. The household appliance of claim 13 wherein the magnet is one of a permanent magnet or electromagnet.

15. The household appliance of claim 14 wherein the electromagnet has a first state where ferrite particles act as a filter and a second state where the ferrite particles do not act as a filter.

16. The household appliance of claim 15 wherein the housing is rotated at a first speed when the electromagnet is in the first state.

17. The household appliance of claim 16 wherein the housing is rotated at a second speed, slower than the first speed, when the electromagnet is in the second state.

* * * * *